US006537384B2

(12) United States Patent
Herwig et al.

(10) Patent No.: US 6,537,384 B2
(45) Date of Patent: Mar. 25, 2003

(54) COMPOSITION AND METHOD FOR ENGINE CLEANING

(75) Inventors: Mark Guenter Herwig, Newburyport, MA (US); Mark Joseph Rechtsteiner, Cincinnati, OH (US); Roy Fred Thornton, Schenectady, NY (US); Bruce Edward Goodwin, Kingston, NH (US)

(73) Assignee: General Electric Company, Schenectady, NY (US)

( * ) Notice: Subject to any disclaimer, the term of this patent is extended or adjusted under 35 U.S.C. 154(b) by 220 days.

(21) Appl. No.: 09/777,635

(22) Filed: Feb. 6, 2001

(65) Prior Publication Data

US 2002/0107162 A1 Aug. 8, 2002

(51) Int. Cl.[7] ..... C11D 3/44

(52) U.S. Cl. ..... 134/40; 134/39; 510/405; 510/407; 510/412; 510/506

(58) Field of Search ..... 510/405, 407, 510/412, 506; 134/39, 40

(56) References Cited

U.S. PATENT DOCUMENTS 5,730,894 A * 3/1998 Minor ..... 252/67

OTHER PUBLICATIONS

"3M HFE International Regulatory Status," pp. 1–2, dated copyright 1995, printed Feb. 6, 2001.

"3M Novec Engineered Fluid HFE–7100", pp. 1–6, dated Aug., 1999, web page printed Feb. 1, 2001.

"Vertrel XF MSDS Sheet", pp. 1–8, DuPont web page, dated revised Sep. 26, 2000; printed Feb. 1, 2001.

"Vertrel: About Vertrel", p. 1, DuPont web page, date copyrighted 2000; printed Feb. 1, 2001.

"Vertrel: Frequently Asked Questions," pp. 1–2, DuPont web page, date copyrigh 2000, printed Feb. 1, 2001.

"3M HFE–7100 MSDS", pp. 1–8; dated Jan. 1, 2000; web page printed Feb. 6, 2001.

* cited by examiner

*Primary Examiner*—Gregory E. Webb
(74) *Attorney, Agent, or Firm*—V. G. Ramaswamy; Pierce Atwood

(57) ABSTRACT

A composition and method for cleaning gas turbine engines to remove fuel or lubricant residues. The composition can include a mixture of hydrofluorocarbon and hydrofluoroether. The method can include the step of directing a pressurized stream of the cleaning composition against one or more portions of the gas turbine engine to remove fuel and/or lubricant residues.

8 Claims, No Drawings

COMPOSITION AND METHOD FOR ENGINE CLEANING

This invention was made with Government support under Subcontract number S1085 under Contract No. F33601-00-F-9145 awarded by the United States Department of the Air Force. The Government has certain rights in this invention.

BACKGROUND OF THE INVENTION

This invention relates generally to gas turbine engines and more particularly to the cleaning of gas turbine engines.

Gas turbine engines are generally required to be tested prior to final delivery to the intended customer. Prior to or during testing of the engine, it may be desirable to remove any fuel or oil residue on engine components to permit identification of any leaks that may occur during test operations. After a leak is identified and repaired, it is desirable to remove any remaining fuel and oil residue prior to shipment to the customer.

One approach to cleaning engines involves using an HCFC (hydrochlorofluorocarbon) composition, such as HCFC 141b. Another approach involves using isopropyl alcohol as a cleaning agent. Still other approaches include using steam, aqueous cleaners, hydrofluoroethers alone or mixed with other substances such as isopropyl alcohol or n-propyl bromide.

One challenge in identifying an acceptable cleaner is that the cleaner should be effective and quick acting, while meeting requirements related to environmental and safety regulations. Such requirements can include flammability, worker exposure limitations, and air and water pollution standards. For instance, the cleaning composition should be nonflammable in use on hot engine surfaces. Additionally, it is desirable to provide an effective cleaning composition which is non-ozone depleting and has a low global warming potential. Water and detergent cleaning compositions have been proposed to provide cleaning effectiveness while meeting safety and environmental requirements. However, such water based compositions have the disadvantage that water does not evaporate quickly, and water based compositions may enter electrical/electronic components on the engine, especially if the water is sprayed under pressure.

Accordingly, it would be desirable to provide a composition and method for cleaning gas turbine engines with improved effectiveness and which also meets requirements related to environmental and safety issues, and which does not pose a potential threat to electrical/electronic components of the gas turbine engine.

BRIEF SUMMARY OF THE INVENTION

The present invention provides a composition and method for cleaning hydrocarbon residue, such as fuel or lubricant residue, from one or more components of a gas turbine engine, including hot surfaces of a gas turbine engine. The composition comprises a fluorine-containing first constituent and a flourine-containing second constituent which is an effective solvent. The first constituent can comprise one or more hydrofluoroethers. The second constituent comprises one or more hydrofluorocarbons. In one embodiment, the composition can comprise less than 75% by volume of each of the hydrofluoroether and the hydrofluorocarbon, and the hydrofluorocarbon content is less than that of the hydrofluoroether. The cleaning composition can include about 40% by volume of Dupont VERTREL XF brand hydrofluorocarbon and about 60% by volume of 3M HFE-7100 NOVEC brand hydrofluoroether.

The present invention also provides a method of cleaning gas turbine engines having a residue, such as fuel or lubricant residue. The method can include the steps of providing a gas turbine engine having a hydrocarbon residue on at least a portion of the gas turbine engine, and applying the cleaning composition to remove the residue. In one embodiment, the cleaning solution is directed in a pressurized stream to remove residue from the gas turbine engine. The cleaning solution can be applied to the gas turbine engine prior to running the gas turbine engine, and/or can be applied to a hot surface of a gas turbine engine during operation of the gas turbine engine. For instance, the cleaning solution can be used to clean fluid conduit components, such as tubing, tubing connections, and tubing fittings, and accessory components such as valves, pumps, gearboxes, and the like.

DETAILED DESCRIPTION OF THE INVENTION

As used in this patent application, the term "hydrofluorocarbon" means an organic compound containing only hydrogen, fluorine and carbon.

The term "hydrofluoroether" means an organic compound containing only hydrogen, fluorine, carbon, and oxygen characterized by an oxygen atom attached (bonded) to two carbon atoms.

The cleaning composition of the present invention is provided by combining two constituents. The constituents are preferably both non-aqueous, non-ozone depleting materials which are not flammable at the operating temperatures associated with exterior surfaces of certain gas turbine engine components. Additionally, the constituents are present at levels which comply with applicable environmental and safety regulations. In particular, the cleaning composition can be effective in removing fuel and lubricant residues while complying with US EPA Significant New Alternatives Policy (SNAP). Further, the first and second constituents are not classified as volatile organic compounds (VOC's), which can aid in minimizing air emmission control requirements, yet the constituents evaporate at a rate which poses no additional risks with respect to employee exposure and water discharge levels.

The cleaning composition includes a first fluorine-containing constituent and a second fluorine-containing constituent which is effective as a solvent. The first constituent can comprise at least one hydrofluoroether. The second constituent can comprise at least one hydrofluorocarbon. The cleaning composition can have a hydrofluoroether content which is greater than the hydrofluorocarbon content, on a volume percent basis. The hydrofluorocarbon is present at a level which provides effective solvent performance for removing oil/fuel residue, yet does not exceed employee exposure levels in air under ordinary conditions of use.

One suitable hydrofluorocarbon has a chemical formula C5H2F10. One suitable hydrofluoroether has a chemical formula C4F9OCH3.

In one embodiment, the cleaning composition comprises less than 75% by volume, preferably less than 60 percent by volume hydrofluorocarbon, and less than 75% by volume hydrofluoroether. The cleaning composition can comprise between about 30 to about 50 percent by volume hydrofluorocarbon, and about 50 to about 70 percent by volume hydrofluoroether. In one particular embodiment, the cleaning composition consists essentially of about 40 percent by volume hydrofluorocarbon and about 60 percent by volume hydrofluoroether.

A suitable cleaning composition can be provided by combining about 60 percent by volume of 3M NOVEC HFE-1700 brand hydrofluoroether, available from the 3M Company of Minneapolis, Minn.; with about 40 percent by volume of VERTREL XF brand hydrofluorocarbon based specialty fluid, available from the DuPont Company. The hydroflourocarbon can be identified as C.A.S. number 138495-42-8. The hydrofluoroether can be a mixture of 50–70 percent methyl nonafluoroisobutyl ether (C.A.S. number 163702-08-7) and 30–50 percent methyl nonafluorobutyl ether (C.A.S. number 163702-07-6).

The cleaning composition can be used to remove oil/fuel residue prior to testing of the engine, during testing of the engine, and after testing of the engine. By way of example, the cleaning composition can be used to remove oil/fuel residue accumulated during assembly of the engine, so that engine testing proceeds with a clean, baseline engine condition. The engine can then be operated at temperature to locate oil/fuel leaks. If oil/fuel leaks are detected, the cleaning composition can be used to locate the source of the leak, the leaks can be repaired, and any oil/fuel residue can be removed from the hot engine surfaces by using the cleaning composition prior to restarting the engine to verify the leaks have been repaired. Prior to final shipment, the cleaning composition can be used to eliminate any remaining fuel/oil residue.

The cleaning composition can be applied to the gas turbine engine components in any suitable manner. In one preferred embodiment, the cleaning composition is directed onto the gas turbine engine as a pressurized liquid mist or stream, such as with a container pressurized with compressed air or other delivery media. Individual aerosol cans of the composition can be provided for small volume needs. Larger quantities can be delivered from a central pressurized container through a spray wand, which can be fitted with nozzles of various configuration.

While specific embodiments of the present invention have been described, it will be apparent to those skilled in the art that various modifications thereto can be made without departing from the spirit and scope of the invention as defined in the appended claims.

What is claimed is:

1. A method of cleaning an engine, the method comprising the steps of:

providing a cleaning composition, the cleaning composition comprising C4F9OCH3 and a hydrofluorocarbon; and applying the cleaning composition to at least a portion of the engine.

2. The method of claim 1 wherein the cleaning composition comprises less than 75% by volume of the hydrofluorocarbon.

3. The method of claim 2 wherein the cleaning composition comprises no more than 50% by volume of the hydrofluorocarbon.

4. The method of claim 1 wherein the cleaning composition comprises between about 30% by volume and about 50% by volume hydrofluorocarbon.

5. The method of claim 1 wherein the step of applying the cleaning composition comprises directing a pressurized stream of the cleaning composition against at least a portion of the engine.

6. A method of cleaning an engine, the method comprising the steps of:

providing a cleaning composition comprising a nonflammable mixture of C4F9OCH3 and a hydrofluorocarbon; and applying the cleaning composition to at least a portion of the engine to remove fuel or lubricant.

7. The method of claim 6 wherein the cleaning composition comprises a mixture of a C5H2F10 and C4F9OCH3.

8. The method of claim 6 wherein the cleaning composition consists essentially of C5H2F10 and C4F9OCH3.

* * * * *